US009126784B2

(12) United States Patent
Aoki et al.

(10) Patent No.: US 9,126,784 B2
(45) Date of Patent: Sep. 8, 2015

(54) PAPER FEEDING DEVICE AND IMAGE FORMING APPARATUS

(71) Applicant: Sharp Kabushiki Kaisha, Osaka (JP)

(72) Inventors: Kohji Aoki, Osaka (JP); Haruhisa Furumoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/274,148

(22) Filed: May 9, 2014

(65) Prior Publication Data

US 2015/0001788 A1 Jan. 1, 2015

(30) Foreign Application Priority Data

Jun. 27, 2013 (JP) ..... 2013-135291

(51) Int. Cl.

| | |
|---|---|
| ***B65H 1/08*** | (2006.01) |
| ***B65H 1/12*** | (2006.01) |
| ***B65H 1/04*** | (2006.01) |
| ***B65H 1/14*** | (2006.01) |

(52) U.S. Cl.

CPC .. *B65H 1/12* (2013.01); *B65H 1/04* (2013.01); *B65H 1/14* (2013.01); *B65H 2405/1117* (2013.01); *B65H 2405/1124* (2013.01); *B65H 2405/1134* (2013.01); *B65H 2405/11162* (2013.01); *B65H 2405/11172* (2013.01)

(58) Field of Classification Search

CPC ..... B65H 1/04; B65H 1/12; B65H 1/14; B65H 1/00; B65H 2405/10; B65H 2405/111; B65H 2405/11162; B65H 2405/11172; B65H 2405/1124; B65H 2405/1134

USPC ..... 271/126, 127, 162, 160

See application file for complete search history.

(56) References Cited

U.S. PATENT DOCUMENTS

| | | | | |
|---|---|---|---|---|
| 7,457,580 | B2 * | 11/2008 | Kitamura | 399/393 |
| 7,673,872 | B2 * | 3/2010 | Lee et al. | 271/160 |
| 7,708,265 | B2 * | 5/2010 | Kusama | 271/117 |
| 8,246,044 | B2 * | 8/2012 | Nishitani et al. | 271/127 |
| 8,448,938 | B2 * | 5/2013 | Ko | 271/127 |
| 8,616,545 | B2 * | 12/2013 | Takiguchi | 271/118 |
| 2003/0116906 | A1 * | 6/2003 | Amamoto | 271/126 |
| 2004/0251600 | A1 * | 12/2004 | Amamoto | 271/152 |
| 2005/0140081 | A1 * | 6/2005 | Sugimura et al. | 271/118 |
| 2005/0286947 | A1 * | 12/2005 | Kitamura | 399/393 |
| 2009/0189329 | A1 * | 7/2009 | Kaseda | 271/4.1 |

FOREIGN PATENT DOCUMENTS

| | | |
|---|---|---|
| JP | 2001-080767 | 3/2001 |
| JP | 2008-201499 | 9/2008 |

* cited by examiner

*Primary Examiner* — Prasad Gokhale

(74) *Attorney, Agent, or Firm* — Renner, Otto, Boisselle & Sklar, LLP

(57) ABSTRACT

A paper feeding device includes a pressing member, a restricting mechanism, and an interlocking mechanism. The pressing member is movable up and down between a pressing position and a release position. The pressing position causes a pressure to a paper sheet against the feed roller. The release position causes a release of the pressure. The restricting mechanism is movable between a restricting position and a removal position. The restricting position causes a restriction on moving up of the pressing member to the pressing position. The removal position causes a removal of the restriction. The interlocking mechanism is configured to move the restricting mechanism to the removal position in interlock with rotation of the feed roller.

21 Claims, 12 Drawing Sheets

PAPER FEEDING DEVICE AND IMAGE FORMING APPARATUS

CROSS REFERENCE TO RELATED APPLICATIONS

This application is based on and claims priority under 35 U.S.C. §119 (a) to Japanese Patent Application 2013-135291, filed on Jun. 27, 2013, the entire contents of which are incorporated herein by reference.

DESCRIPTION OF THE RELATED ART

The present invention relates to a paper feeding device that feeds a paper sheet placed on a tray by rotation of a feed roller and to an image forming apparatus that includes this paper feeding device.

A paper feeding device with a paper feed mechanism for feeding a paper sheet placed on a tray is widely used for an image forming apparatus such as a printer machine, a facsimile machine, and a copying machine for forming an image on a fed paper sheet. For example, Japanese Unexamined Patent Application Publication No. 2001-80767 discloses a paper feed mechanism that presses paper sheets stacked on a paper feed tray against a feed roller so as to feed the paper sheets by rotation of the feed roller.

The paper feed mechanism disclosed in Japanese Unexamined Patent Application Publication No. 2001-80767 presses paper sheets against the feed roller by transmitting a rotation output of a rotation driving portion of the feed roller to a paper feeding elevator mechanism portion via an electromagnetic clutch when the height of the paper sheets stacked on the paper feed tray decreases from a predetermined position.

However, the paper feed mechanism disclosed in Japanese Unexamined Patent Application Publication No. 2001-80767 has a large size because the electromagnetic clutch is used. The large size of the paper feed mechanism leads to an increase in size of the paper feeding device using this mechanism, and further leads to an increase in size of the image forming apparatus. Additionally, the electromagnetic clutch leads to a complicated control system.

SUMMARY OF THE INVENTION

It is an object of the present invention to provide a paper feeding device that achieves moving up of a pressing member to press paper sheets placed on a tray without using an electromagnetic clutch, which allows reducing the size of the paper feeding device without causing an unnecessarily complicated control system, and to provide an image forming apparatus that includes this paper feeding device.

The present invention provides, to solve the above-described problem, a paper feeding device for pressing a paper sheet placed on a tray against a feed roller to feed the paper sheet to a feeding destination by rotation of the feed roller. The paper feeding device includes the pressing member, a restricting mechanism, and an interlocking mechanism. The pressing member is movable up and down between a pressing position and a release position. The pressing position causes a pressure to a paper sheet against the feed roller. The release position causes a release of the pressure. The restricting mechanism is movable between a restricting position and a removal position. The restricting position causes a restriction on moving up of the pressing member to the pressing position. The removal position causes a removal of the restriction. The interlocking mechanism is configured to move the restricting mechanism to the removal position in interlock with rotation of the feed roller. The present invention also provides an image forming apparatus that includes the paper feeding device according to the present invention and an image forming portion configured to form an image on a paper sheet fed from the paper feeding device.

In the present invention, the interlocking mechanism includes an interlocking rotating body, a contacting member, and a pressure contact member. The interlocking rotating body configured to rotate in interlock with rotation of the feed roller. The contacting member configured to move the restricting mechanism in contact with the restricting mechanism. The pressure contact member is configured to bring the interlocking rotating body into pressure contact with the contacting member. The contacting member presses the restricting mechanism in association with rotation of the interlocking rotating body in pressure contact until the restricting mechanism moves to at least the removal position. This aspect is shown as an example.

In the present invention, the contacting member is configured to: provide a pressure until the restricting mechanism moves to the removal position by an interlocking action in association with rotation of the interlocking rotating body in pressure contact; stop the interlocking action after the restricting mechanism has reached the removal position; and then be brought into slidable contact with the interlocking rotating body in a rotating state. This aspect is shown as an example.

In the present invention, the interlocking rotating body is a spur gear in a closed-bottomed cylindrical shape where teeth are formed on a side surface, and meshes with a roller-side gear via an intermediate gear. The roller-side gear is configured to rotate together with the feed roller by rotation of a shaft shared with the feed roller. The pressure contact member is a compression spring internally fitted to the interlocking rotating body so as to bring a bottom surface of the interlocking rotating body into pressure contact with the contacting member. The contacting member is loose-fitted to a shaft for pivotally supporting the intermediate gear, holds a shaft of the interlocking rotating body, and is configured to press the restricting mechanism in association with rotation of the interlocking rotating body in pressure contact as a rocking cam that rocks around a shaft of the intermediate gear as a rocking center. This aspect can be shown as an example.

In the present invention, the restricting mechanism has an engaging hole that engages the pressing member, engages the pressing member in the restricting position, and removes the engagement in the removal position. This aspect can be shown as an example.

In the present invention, the restricting mechanism includes an engaging member and a rocking member. The engaging member has the engaging hole. The rocking member is coupled to the engaging member. The rocking member is configured to rock by an action of the interlocking mechanism. The engaging member is configured to move from the restricting position to the removal position in interlock with rocking of the rocking member. This aspect is shown as an example.

In the present invention, the restricting mechanism includes the engaging member in a long plate shape with an engaging hole configured to engage the pressing member in the restricting position and a rocking member coupled to the engaging member. The rocking member is configured to rock by an action of the interlocking mechanism. The rocking member includes a slide link portion configured to convert the rocking by the action of the interlocking mechanism into a linear motion in a longitudinal direction of the engaging member. The engaging member is movable in a longitudinal direction between the restricting position and the removal position. The restricting position causes the engaging member to engage the pressing member in the engaging hole. The removal position causes a removal of the engagement. The engaging member includes a coupling engagement portion that engages the slide link portion, and the coupling engagement portion is configured to move from the restricting position to the removal position by an action of the slide link portion. This aspect can be shown as an example.

In the present invention, the pressing member has a plate shape with a placement surface on which a paper sheet is placed, and the pressing member includes a rocking shaft, a compression spring, and an engaging claw. The rocking shaft is arranged parallel to a rotation shaft of the feed roller. The compression spring is positioned on a back side of the placement surface. The engaging claw is configured to engage the restricting mechanism. This aspect can be shown as an example.

DESCRIPTION OF PREFERRED EMBODIMENTS

Embodiments of the present invention will be described below by referring to the accompanying drawings. The following embodiments are examples of embodying the present invention, and do not limit the technical scope of the present invention.

(First Embodiment)

Figure 1:
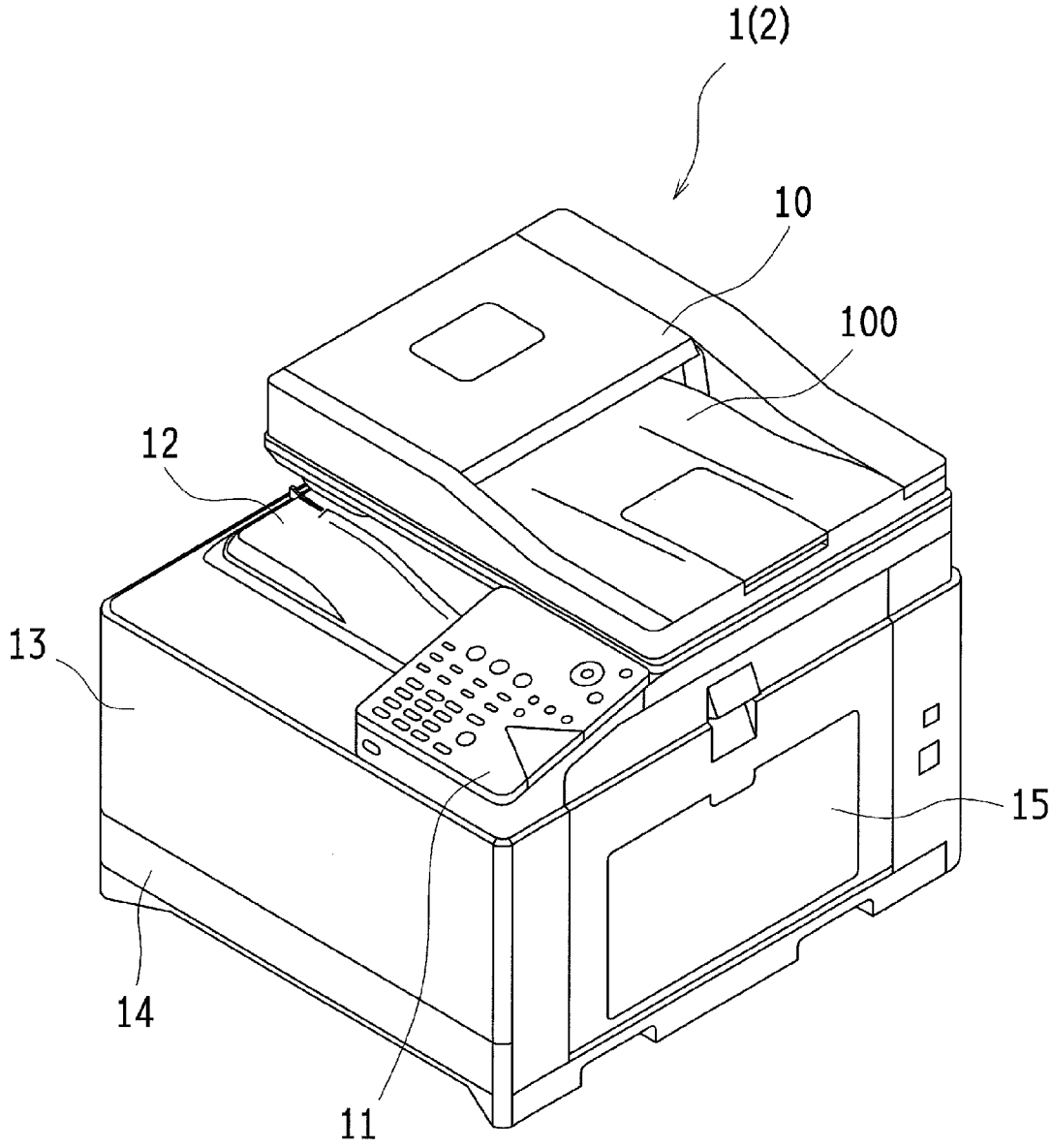
FIG. 1 is a schematic perspective view illustrating one example of the external appearance of a paper feeding device according to the present invention.
Figure 2:
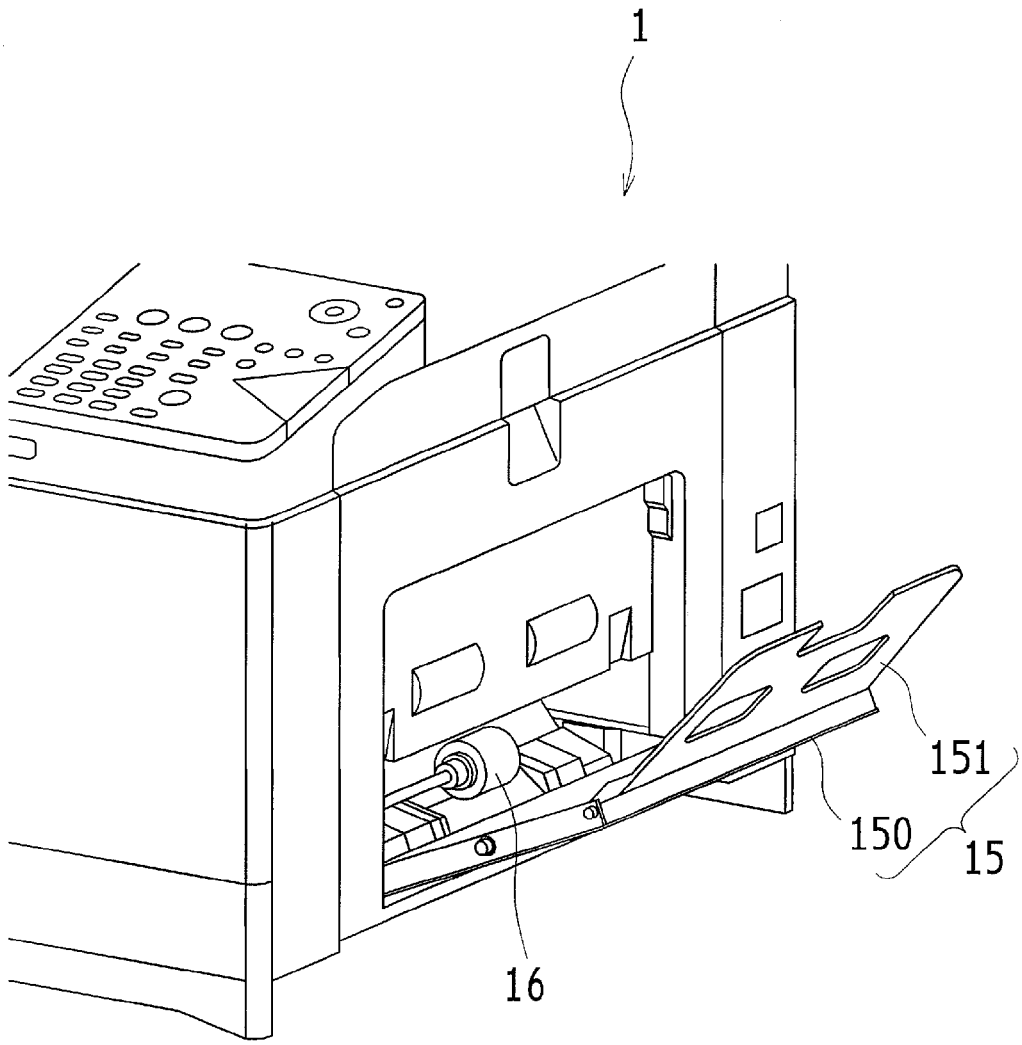
FIG. 2 is a schematic perspective view illustrating an example of a part of the external appearance of the paper feeding device according to the present invention.

FIG. 1 is a schematic perspective view illustrating one example of an external appearance of a paper feeding device according to the present invention. FIG. 2 is a schematic perspective view illustrating an example of a part of the external appearance of the paper feeding device according to the present invention. FIG. 1 and FIG. 2 each illustrate a paper feeding device 1 according to the present invention as an application example to an image forming apparatus 2 that includes an image forming portion described later inside, for example, a printer machine, a facsimile machine, and a copying machine. However, in the following description, the present invention will be described as the paper feeding device 1 and also described as the image forming apparatus 2 as necessary.

The paper feeding device 1 is formed in an approximately three-dimensional shape, and has an upper portion in which a reading portion 10 is arranged. The reading portion 10 reads an image formed on a document. The reading portion 10 includes a placement table 100 on which a document to be a reading target is placed. The reading portion 10 takes in the document placed on the placement table 100 using a take-in roller (not illustrated) so as to read the image from the taken document, and then discharges the document.

In the upper portion of the paper feeding device 1, an operation panel 11 that accepts an operation of the user is arranged on the near side of the reading portion 10. In the operation panel 11, various keys are arranged. Below the reading portion 10, a discharging portion 12 is arranged. The discharging portion 12 discharges a paper sheet on which an image is formed.

On the front surface (the left side in the view) of the paper feeding device 1, an opening/closing portion 13 that is openable/closable and a drawable drawer of a storing portion 14 are arranged. Opening the opening/closing portion 13 allows performing works such as exchange of an ink cartridge loaded inside of the paper feeding device 1. The storing portion 14 arranged below the opening/closing portion 13 is a paper sheet cassette that stacks and stores paper sheets. Drawing the storing portion 14 allows performing works such as storing of paper sheets.

On the right side surface of the paper feeding device 1, an openable/closable bypass tray 15 is arranged. The bypass tray 15 is used for using a paper sheet other than the paper sheet stored in the storing portion 14. FIG. 2 illustrates a state where the bypass tray 15 is opened, and illustrates a state where a cover plate 150 is opened and a folded plate 151 is opened. The cover plate 150 is formed in a rectangular shape, and has one long side pivotally supported in a rockable manner on the main body of the paper feeding device 1. The folded plate 151 is pivotally supported in a rockable manner on the other long side of the cover plate 150. Respective surfaces of the opened cover plate 150 and the opened folded plate 151 at the main body side correspond to the bottom surface of the bypass tray 15. On the bottom surface, paper sheets to be an image forming medium are placed. In the back of the bypass tray 15, a feed roller 16 is arranged. The feed roller 16 takes in the paper sheet placed on the bypass tray 15.

Figure 3:
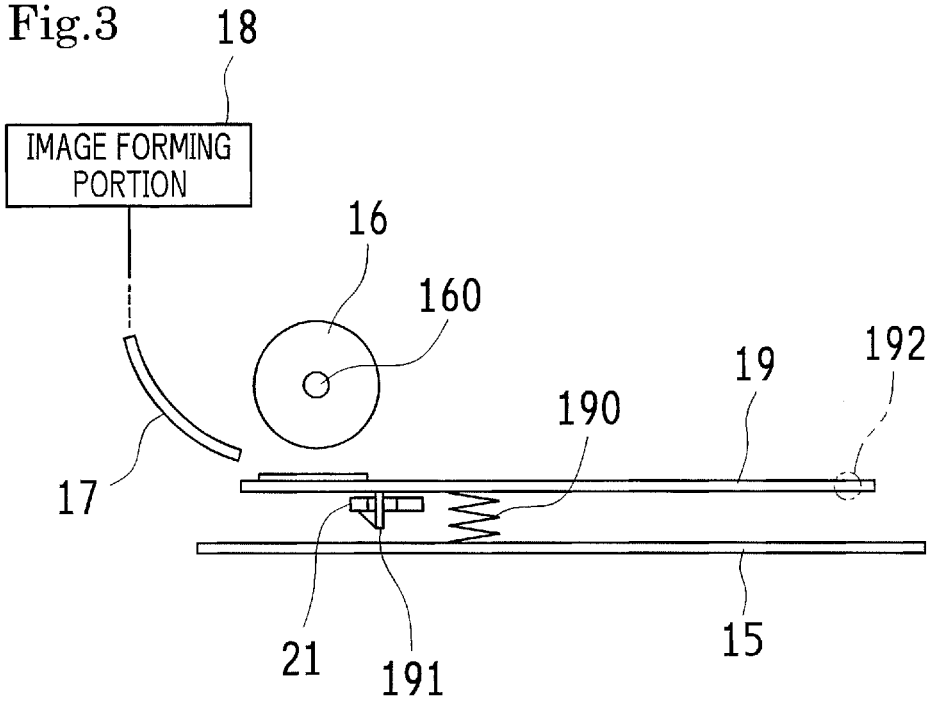
FIG. 3 is a side view schematically illustrating one example of a bypass tray of the paper feeding device according to the present invention.
Figure 4:
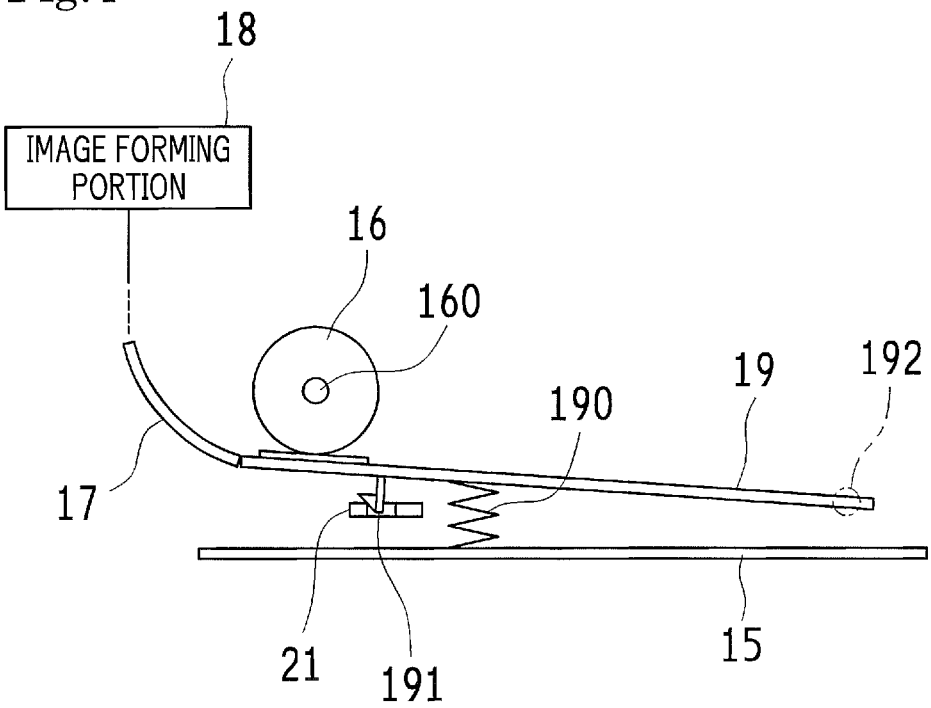
FIG. 4 is a side view schematically illustrating one example of the bypass tray of the paper feeding device according to the present invention.

FIG. 3 and FIG. 4 are side views each schematically illustrating one example of the bypass tray 15 of the paper feeding device 1 according to the present invention. In the paper feeding device 1 according to the present invention, the feed roller 16 pivotally supported on a rotation shaft 160 rotates so as to feed the paper sheet on the bypass tray 15 one-by-one to an image forming portion 18 along a conveyance guide 17 from the paper sheets placed in the highest position. The image forming portion 18 charges the fed paper sheet based on the image read from the document and transfers toner so as to form an image on the paper sheet. The paper sheet on which the image is formed is discharged from the discharging portion 12.

To feed the paper sheet by rotation of the feed roller 16, a pressing member 19 such as an elevator tray that can move up and down is arranged on the bottom surface of the bypass tray 15. The paper sheets placed on the bypass tray 15 are pressed against the feed roller 16 by the pressing member 19. The pressing member 19 moves up and down between a pressing position for pressing the paper sheets against the feed roller 16 and a release position for releasing the pressing. FIG. 3 illustrates a state of the pressing member 19 in the release position. FIG. 4 illustrates a state of the pressing member 19 in the pressing position.

In the case where the pressing member 19 is in the release position, a work for placing paper sheets on the bypass tray 15 can be performed. When the feed roller 16 starts rotating, the pressing member 19 moves up to the pressing position so as to start feeding the paper sheets.

The pressing member 19 is formed in a rectangular plate shape with a placement surface on which paper sheets are placed. On the back side of the placement surface, a pressing compression spring 190 is arranged. The pressing compression spring 190 provides a pressure from the bottom surface of the bypass tray 15.

Additionally, on the back side of the pressing member 19, an engaging claw 191 that engages a restricting mechanism 21 described below is disposed. Engagement of the engaging claw 191 with the restricting mechanism 21 holds the pressing member 19 in the release position. Subsequently, when the engaging claw 191 is disengaged, the pressing member 19 is pushed up by the pressing compression spring 190 so as to move up to the pressing position. Moving up to the pressing position is rocking around a rocking shaft 192 arranged parallel to the rotation shaft 160 of the feed roller 16. Moving up of the pressing member 19 by rocking causes a state appropriate for feeding to the conveyance guide 17.

Figure 5:
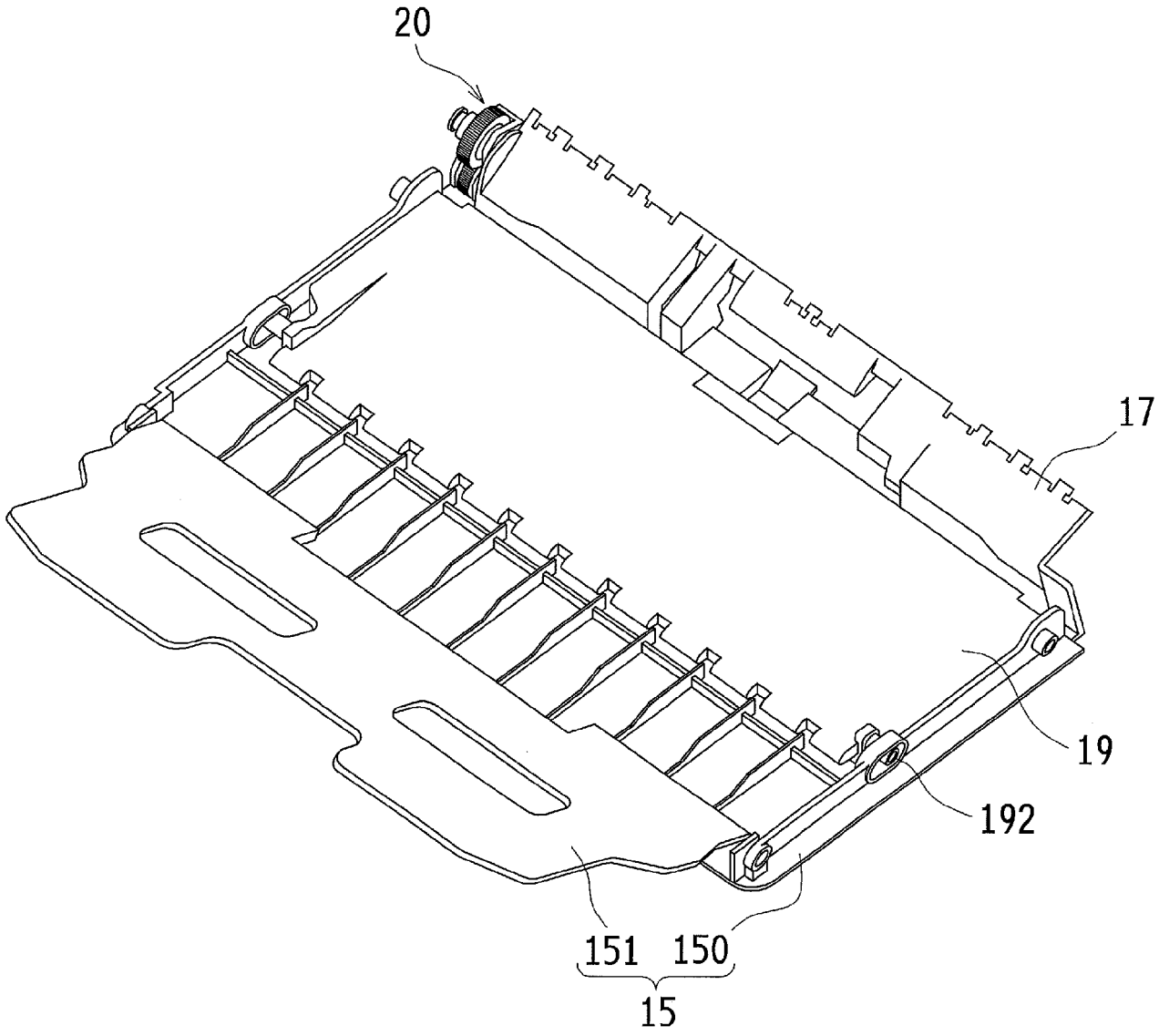
FIG. 5 is a schematic perspective view illustrating one example of the bypass tray and members at the periphery of the bypass tray in the paper feeding device according to the present invention.
Figure 6:
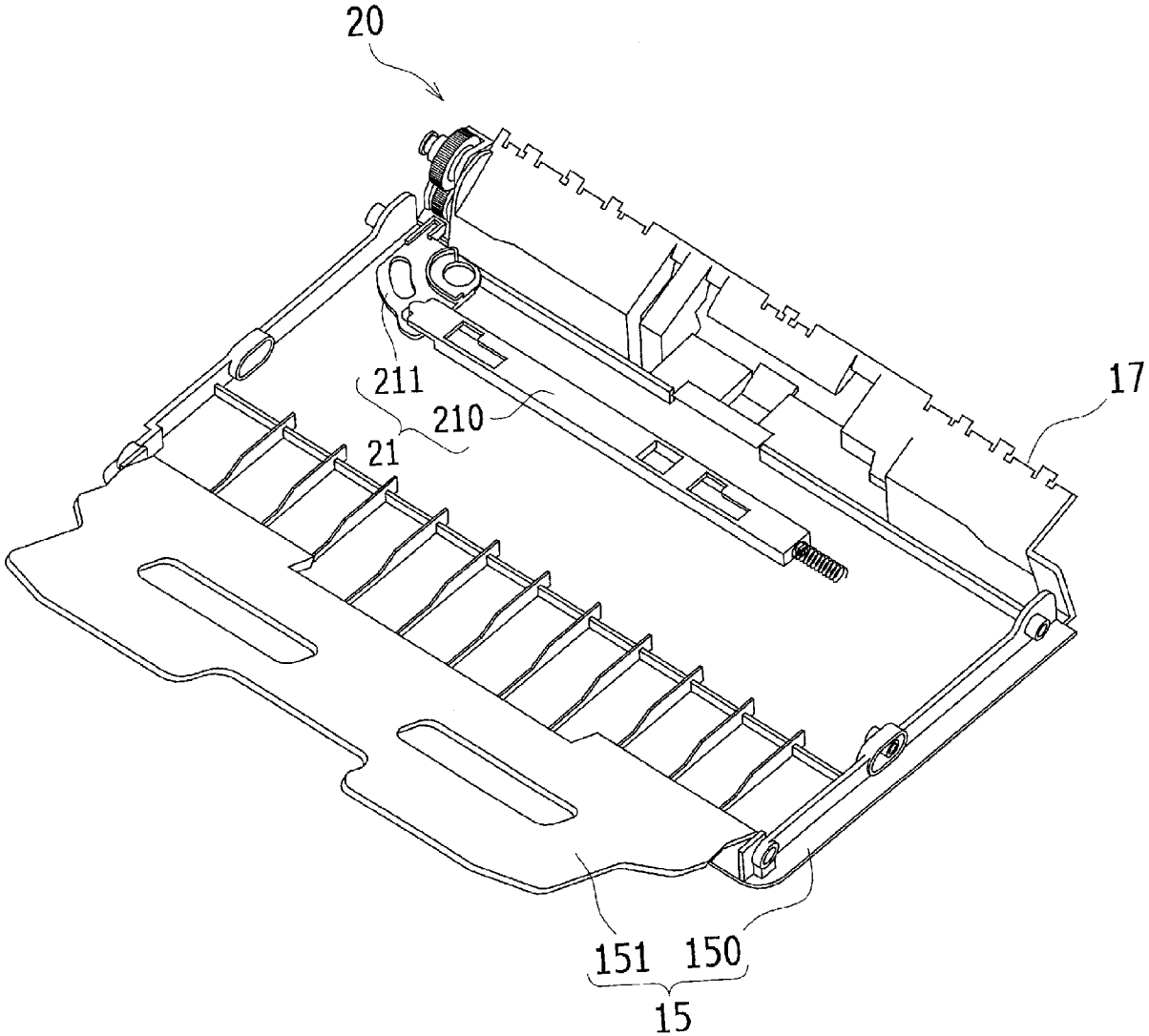
FIG. 6 is a schematic perspective view illustrating one example of the bypass tray and members at the periphery of the bypass tray in the paper feeding device according to the present invention.
Figure 7:
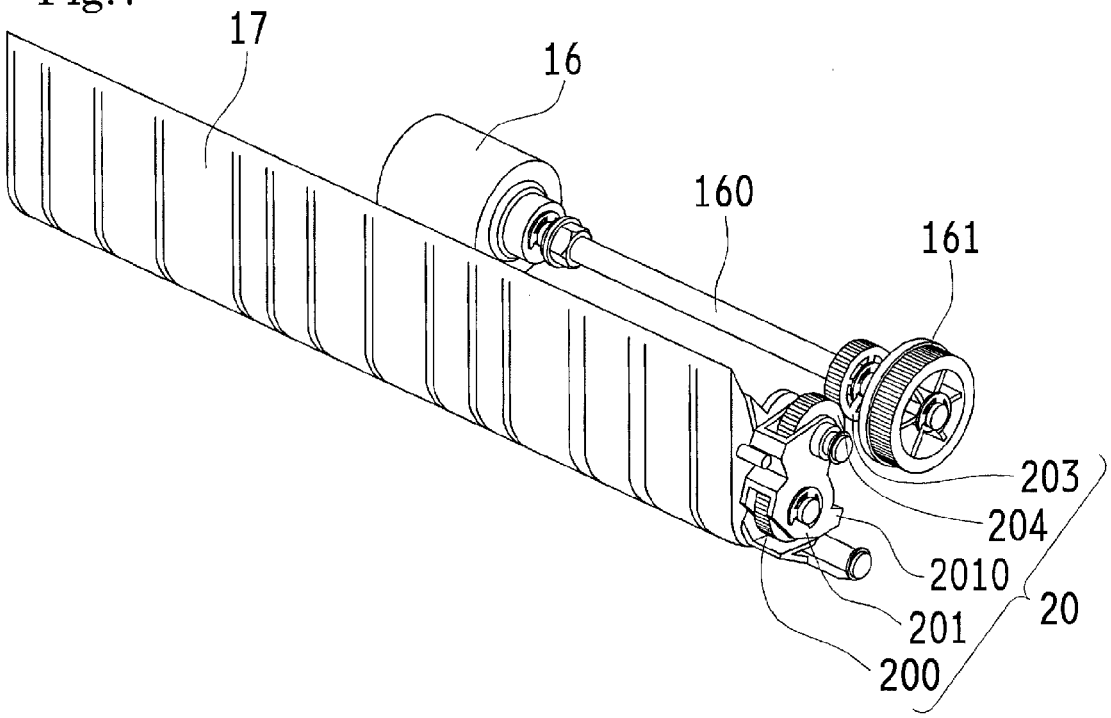
FIG. 7 is a schematic perspective view illustrating one example of a feed roller and members at the periphery of the feed roller in the paper feeding device according to the present invention.
Figure 8:
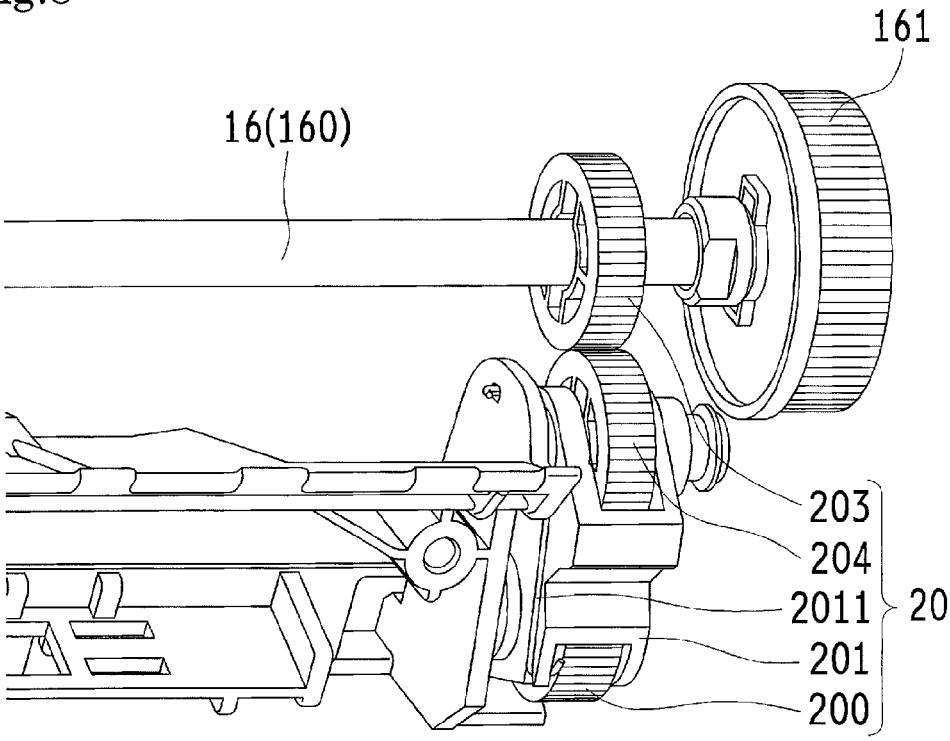
FIG. 8 is a schematic perspective view illustrating one example of a feed roller and members at the periphery of the feed roller in the paper feeding device according to the present invention.
Figure 9:
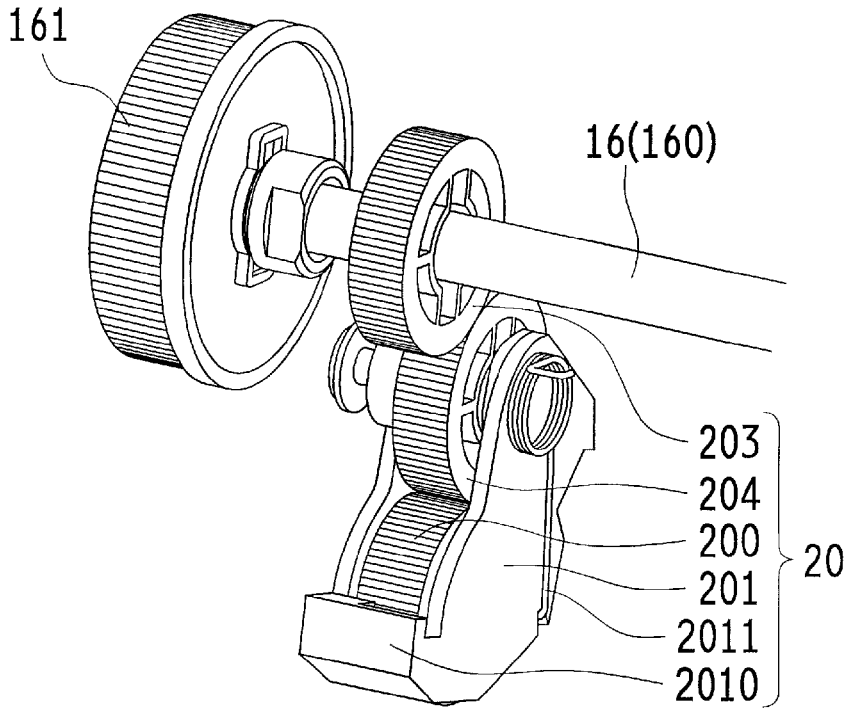
FIG. 9 is a schematic perspective view illustrating one example of a feed roller and members at the periphery of the feed roller in the paper feeding device according to the present invention.
Figure 10:
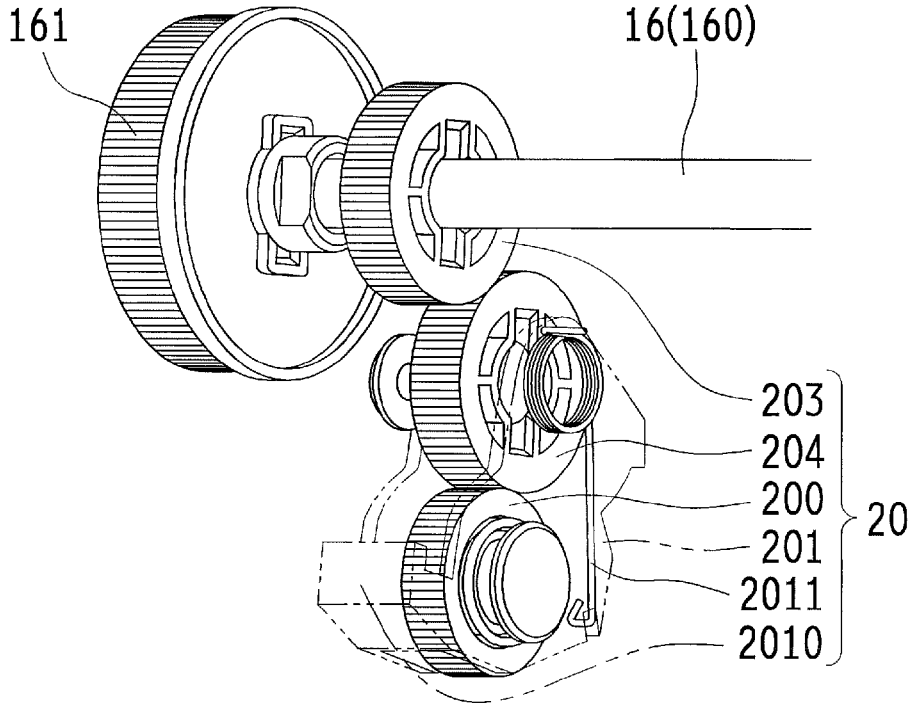
FIG. 10 is a schematic perspective view illustrating one example of a feed roller and members at the periphery of the feed roller in the paper feeding device according to the present invention.

FIG. 5 and FIG. 6 are schematic perspective views each illustrating the bypass tray 15 and some members at the periphery of the bypass tray 15 in the paper feeding device 1 according to the present invention. FIG. 5 illustrates the entire bypass tray 15 in a state where the cover plate 150 is opened and the folded plate 151 is opened. FIG. 6 illustrates a state where the pressing member 19 is removed from FIG. 5.

On the bottom surface of the bypass tray 15, the pressing member 19 formed in a plate shape is arranged. The pressing member 19 is formed in a rectangular shape, and has one long side where the rocking shaft 192 is arranged parallel to the rotation shaft 160 of the feed roller 16 and has the other long side positioned in the vicinity of the conveyance guide 17. The conveyance guide 17 has a width similar to the width of the bypass tray 15 in a direction perpendicular to the paper feeding direction. On the left end side of the conveyance guide 17 in the paper feeding direction, an interlocking mechanism 20 is arranged.

The paper feeding device 1 according to the present invention includes the above-described pressing member 19, the restricting mechanism 21, and the interlocking mechanism 20. The restricting mechanism 21 is movable between a restricting position for restricting moving up of the pressing member 19 and a removal position for removing the restriction. The interlocking mechanism 20 moves the restricting mechanism 21 to the removal position in interlock with the rotation of the feed roller 16. The following describes the interlocking mechanism 20 and the restricting mechanism 21 in sequence.

<Description of Interlocking Mechanism 20>

FIG. 7, FIG. 8, FIG. 9, and FIG. 10 are schematic perspective views each illustrating one example of the feed roller 16 and members at the periphery of the feed roller 16 in the paper feeding device 1 according to the present invention. At one end of the rotation shaft 160 that pivotally supports the feed roller 16, a drive gear 161 is disposed. The drive gear 161 is rotatably driven by a driving portion (not illustrated) using a motor. The feed roller 16 rotate by power transmitted via the drive gear 161.

The rotation shaft 160 of the feed roller 16 couples to the interlocking mechanism 20 in the vicinity of the one end side at which the drive gear 161 is disposed. The interlocking mechanism 20 interlocks with the rotation of the feed roller 16. The interlocking mechanism 20 includes an interlocking rotating body 200, a contacting member 201, and a pressure contact member 202 such as an interlocking compression spring (see FIG. 11). The interlocking rotating body 200 rotates in interlock with the rotation of the feed roller 16. The contacting member 201 contacts the restricting mechanism 21. The pressure contact member 202 brings the interlocking rotating body 200 into pressure contact with the contacting member 201. The pressure contact member 202 included in the interlocking mechanism 20 will be described later.

The interlocking rotating body 200 is a spur gear in a closed-bottomed cylindrical shape where meshing teeth are formed on the side surface, and meshes with the roller-side gear 203 pivotally supported on the rotation shaft 160 of feed roller 16 via the intermediate gear 204. The contacting member 201 is formed using a holder that holds the rotation shaft of the interlocking rotating body 200, and is loose-fitted to the rotation shaft that pivotally supports the intermediate gear 204. Here, loose-fitted means the state that is rockable with respect to the rotation shaft and allows movement independent from the intermediate gear 204 that has the same rotation shaft.

The contacting member 201 formed as a holder includes a contacting portion 2010 in contact with the restricting mechanism 21, and functions as a rocking cam that uses the rotation shaft of the intermediate gear 204 as a rocking axis. The contacting member 201 as the rocking cam rises up in association with rocking in association with the rotation of the interlocking rotating body 200 in pressure contact. Subsequently, the contacting portion 2010 is brought into contact with the restricting mechanism 21. Subsequently, the contacting member 201 rocks in association with additional rotation of the interlocking rotating body 200. Accordingly, the restricting mechanism 21 is pressed in contact with the contacting portion 2010 until the restricting mechanism 21 moves to the removal position for removing engagement of the pressing member 19. The contacting member 201 presses the restricting mechanism 21 until the restricting mechanism 21 moves to the removal position due to rocking in interlock with the rotation of the interlocking rotating body 200 in pressure contact. Subsequently, the contacting member 201 stops the rocking as an interlocking action after the restricting mechanism 21 has reached the removal position due to a reaction from the restricting mechanism 21 whose movement is regulated in the removal position, so as to maintain the state in slidable contact with the interlocking rotating body 200 in a rotating state.

Additionally, a biasing member 2011 such as a kick spring is attached to the contacting member 201 by engaging. The biasing member 2011 biases the contacting member 201 in the opposite direction of the rocking direction by interlock with the interlocking rotating body 200. When the interlocking rotating body 200 stops rotating due to stop of the rotation of the feed roller 16, the contacting member 201 rocks in the opposite direction to the rocking direction in interlock with the interlocking rotating body 200 by the biasing member 2011 and returns to the position before the interlock is started.

Figure 11:
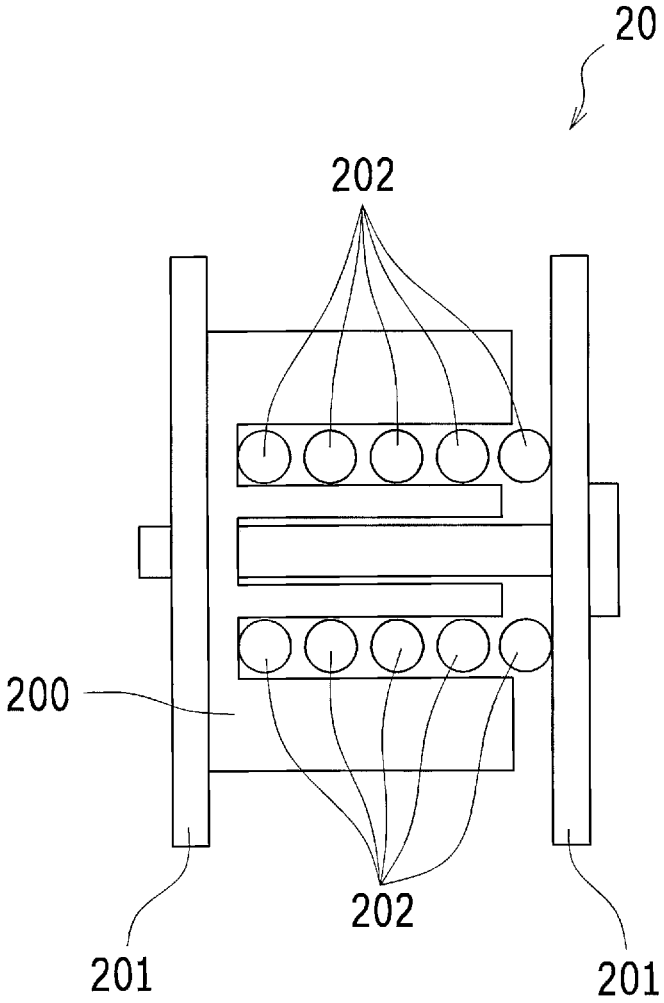
FIG. 11 is a cross-sectional view schematically illustrating one example of an interlocking mechanism in the paper feeding device according to the present invention.

FIG. 11 is a cross-sectional view schematically illustrating one example of the interlocking mechanism 20 in the paper feeding device 1 according to the present invention. FIG. 11 schematically illustrates a cross-section of the interlocking mechanism 20 taken along the surface parallel to the rotation shaft of the interlocking rotating body 200. The bottom surface of the interlocking rotating body 200 in the closed-bottomed cylindrical shape is brought into contact with the inner wall of the contacting member 201 illustrated on the right side in the view. The pressure contact member 202 such as an interlocking compression spring is internally fitted to the interlocking rotating body 200. The bottom surface of the interlocking rotating body 200 is pressed to the contacting member 201 due to the biasing of the pressure contact member 202. The contacting member 201 and the interlocking rotating body 200 are in slidable contact with each other. Accordingly, the contacting member 201 rocks in interlock with the interlocking rotating body 200 until the restricting mechanism 21 reaches the removal position. On the other hand, after the restricting mechanism 21 reaches the removal position, the movement of the restricting mechanism 21 is regulated. Accordingly, the contacting member 201 and the interlocking rotating body 200 are brought into slidable contact with each other.

<Description of Pressing Member 19 and Restricting Mechanism 21>

Figure 12:
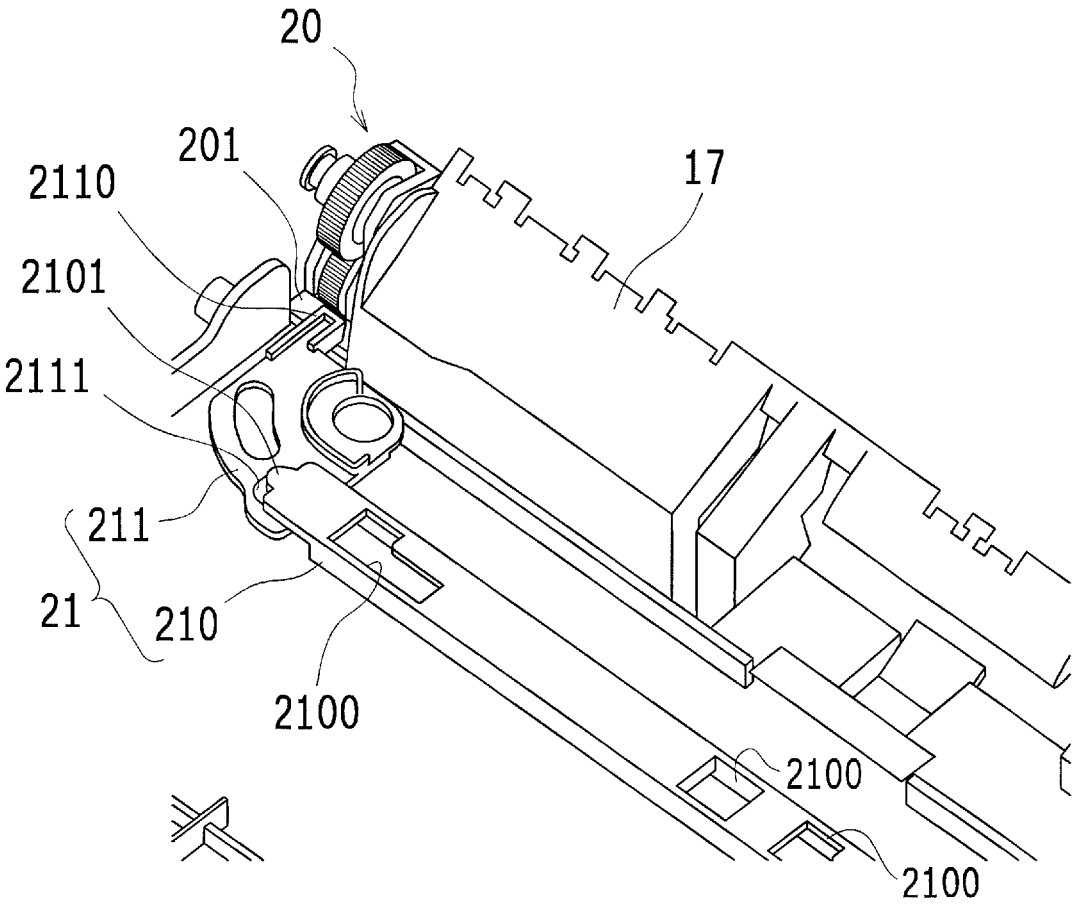
FIG. 12 is a schematic perspective view illustrating one example of the bypass tray and the members at the periphery of the bypass tray in the paper feeding device according to the present invention.
Figure 13:
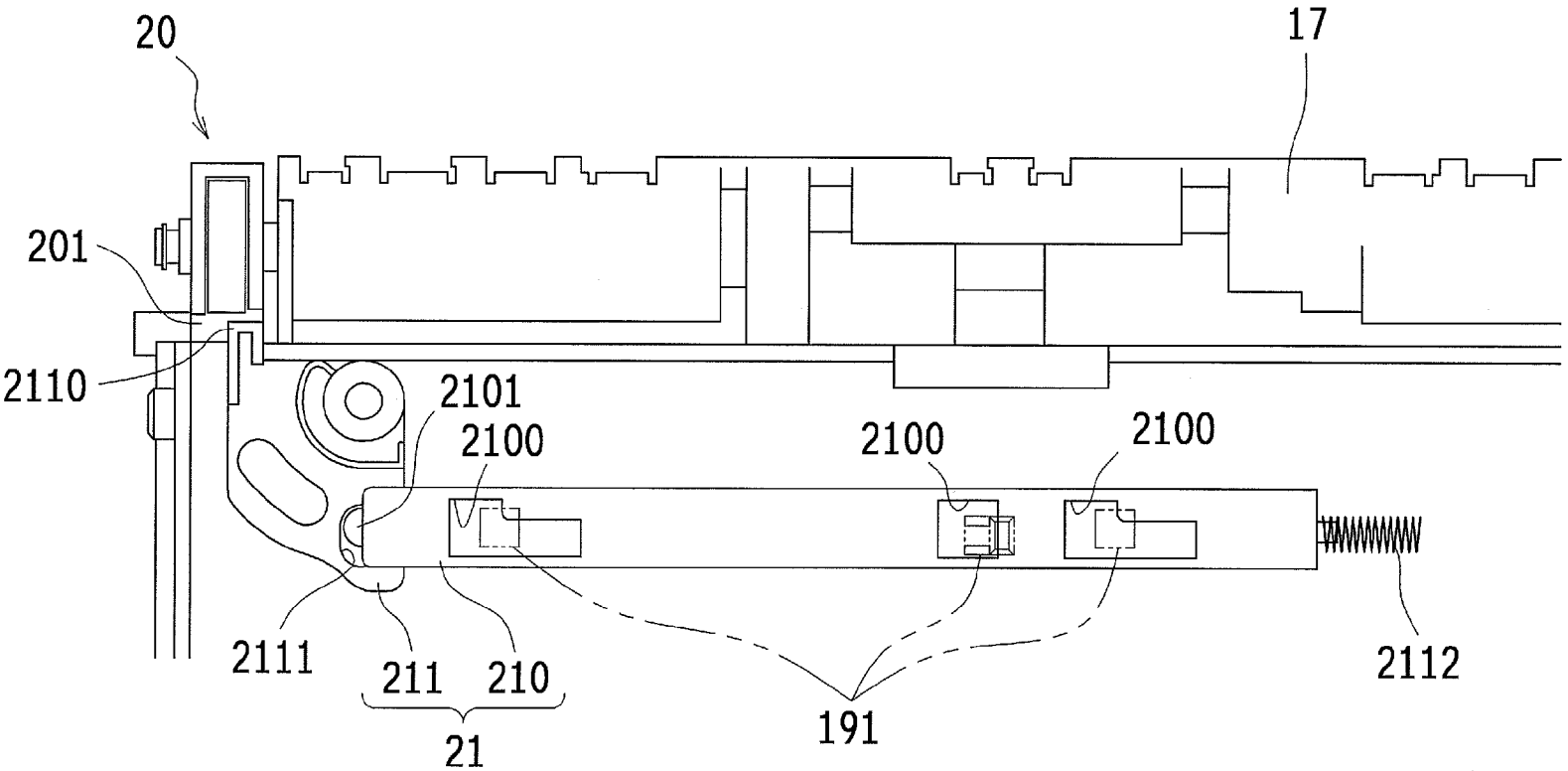
FIG. 13 is a schematic diagram illustrating one example of the bypass tray and the members at the periphery of the bypass tray in the paper feeding device according to the present invention.
Figure 14:
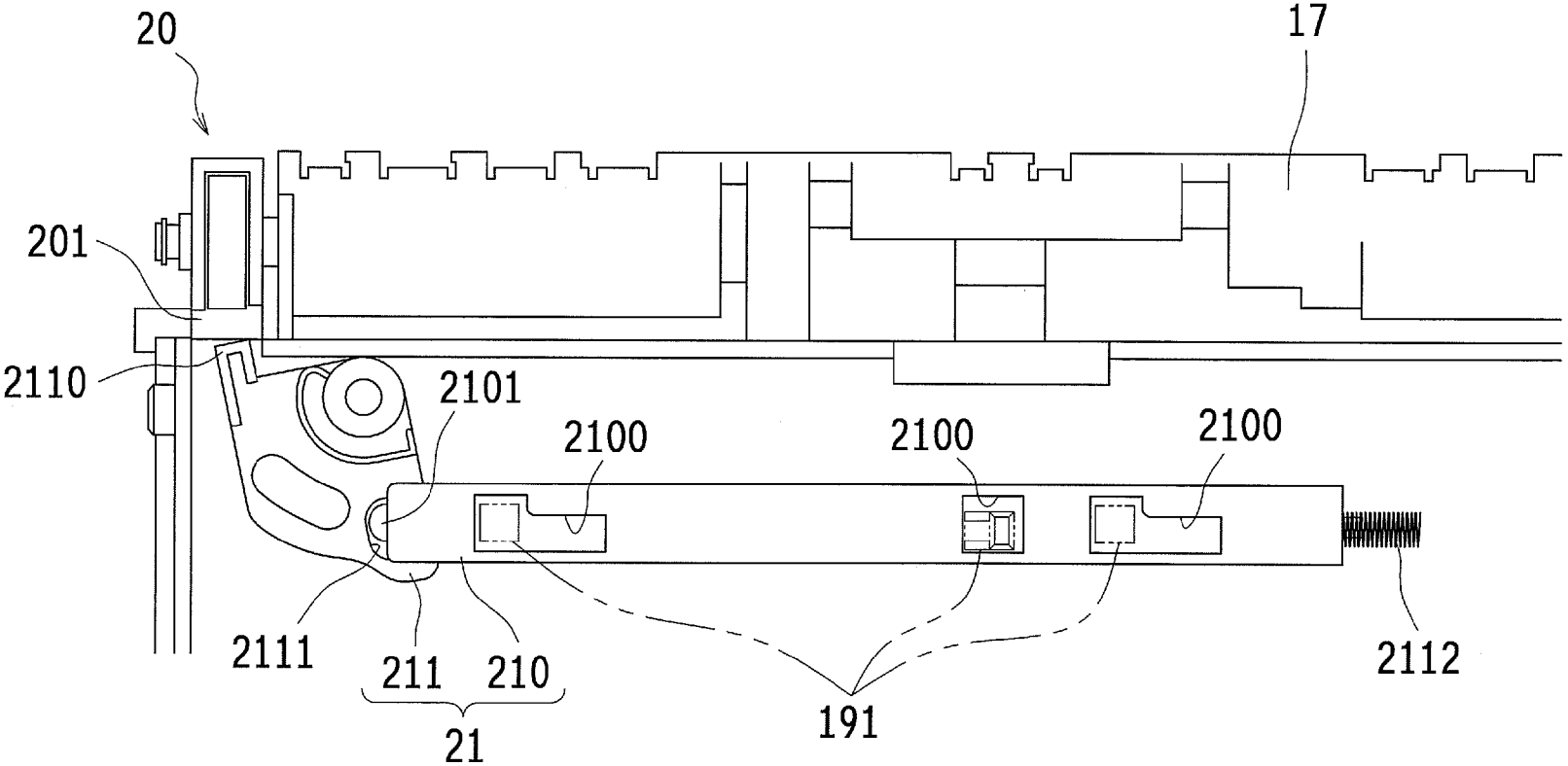
FIG. 14 is a schematic diagram illustrating one example of the bypass tray and the members at the periphery of the bypass tray in the paper feeding device according to the present invention.
Figure 15:
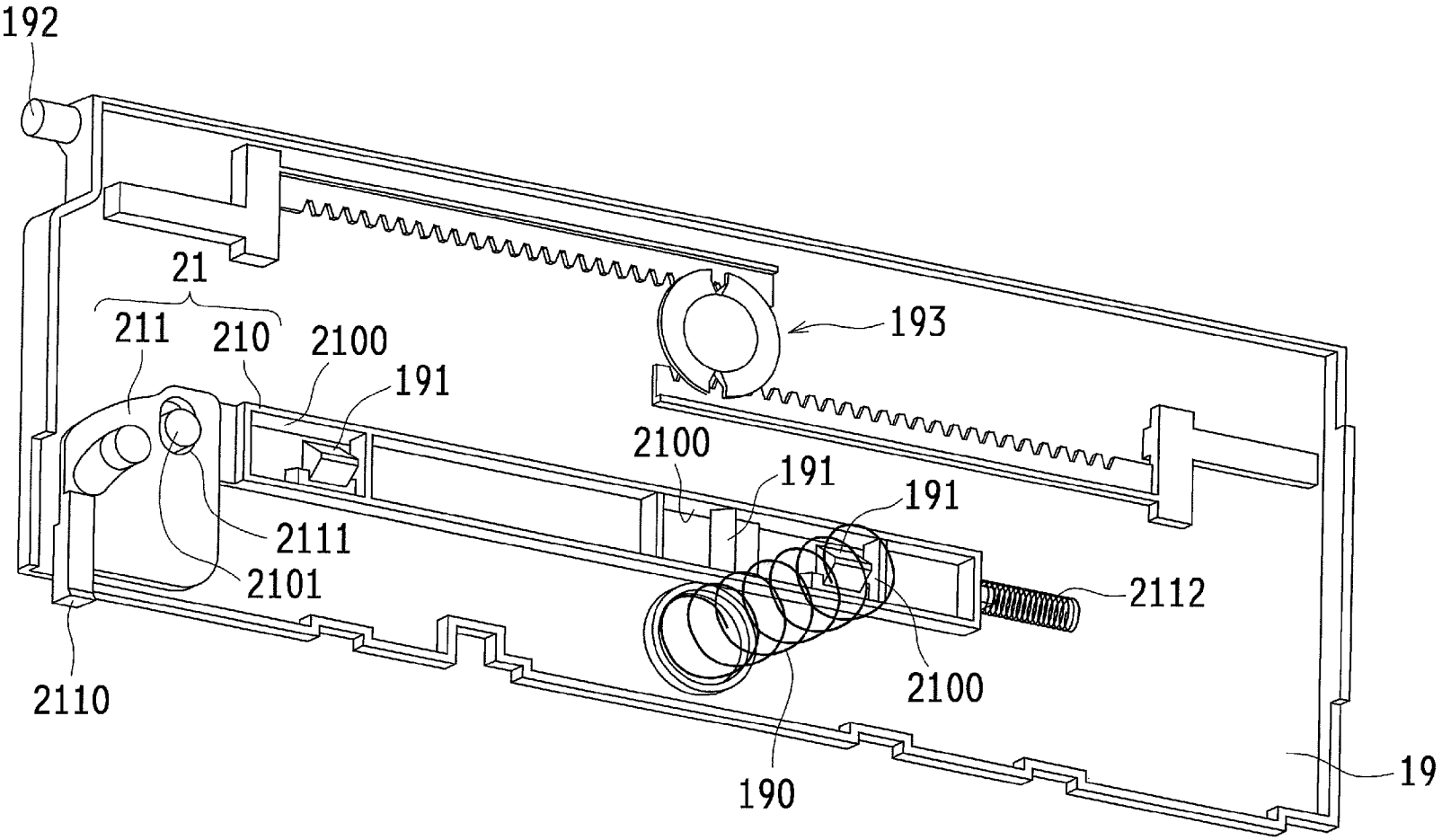
FIG. 15 is a schematic diagram illustrating one example of the bypass tray and the members at the periphery of the bypass tray in the paper feeding device according to the present invention.

FIG. 12 is a partial enlarged view of FIG. 6. FIG. 13, FIG. 14, and FIG. 15 are schematic diagrams each illustrating one example of the bypass tray 15 and members at the periphery of the bypass tray 15 in the paper feeding device 1 according to the present invention. FIG. 13 and FIG. 14 are enlarged views of the restricting mechanism 21 at the center in a state where the pressing member 19 illustrated in FIG. 6 is removed. FIG. 13 illustrates a state where the restricting mechanism 21 is in the engaged position. FIG. 14 illustrates a state where the restricting mechanism 21 is in the removal position. FIG. 15 illustrates the pressing member 19 assuming that the cover plate 150 of the bypass tray 15 is transparent from the lower side.

On the bottom surface of the bypass tray 15 below the pressing member 19, the restricting mechanism 21 is disposed. The restricting mechanism 21 is movable between: the restricting position for restricting moving up of the pressing member 19 from the release position to the pressing position, and the removal position for removing the restriction. The restricting mechanism 21 is formed in a long plate shape, and includes an engaging member 210 and a rocking member 211. In the engaging member 210, engaging holes 2100 that engage respective engaging claws 191 of the pressing member 19 in the restricting position are formed. The rocking member 211 is coupled to the engaging member 210.

Here, in the illustrated example, three engaging claws 191, 191, and 191 are arranged on a straight line. Respective three engaging holes 2100, 2100, and 2100 corresponding to the three engaging claws 191, 191, and 191 are formed to be arranged along the longitudinal direction of the engaging member 210. However, in FIG. 13 and FIG. 14, the positions corresponding to the engaging claws 191, 191, and 191 are illustrated by virtual lines. One engaging claw 191 in the center of the three engaging claws 191, 191, and 191 arranged on the straight line is a claw extending toward the longitudinal direction of the engaging member 210. Two engaging claws 191 and 191 on the end sides are claws extending toward the width direction of the engaging member 210. Additionally, the two engaging claws 191 and 191 on the end sides each have a function as a guide for movement of the engaging member 210.

The rocking member 211 has an approximately fan-shaped plate shape in which the central angle is formed as a right angle, and is pivotally supported in a rockable manner in the circumferential direction around the center of the fan. On one end of the fan-shaped arc of the rocking member 211, a protruding portion 2110 in contact with the contacting member 201 of the interlocking mechanism 20 is disposed to protrude. The rocking member 211 rocks by action of the pressing action from the interlocking mechanism 20 in contact with the protruding portion 2110. On the other end of the fan-shaped arc of the rocking member 211, a slide link portion 2111 is disposed. The slide link portion 2111 converts rocking by the pressing action from the interlocking mechanism 20 into a linear motion of the engaging member 210 in the longitudinal direction.

The engaging member 210 formed in a long plate shape is arranged to have the longitudinal direction parallel to the rotation shaft 160 of the feed roller 16. In the location of the engaging member 210, a guide (not illustrated) is disposed such that the engaging member 210 is linearly slidable from the restricting position to the removal position in the longitudinal direction. The engaging member 210 has one end (the left end in the view) as a coupling engagement portion 2101 engaged with the slide link portion 2111 of the rocking member 211. The slide link portion 2111 of the rocking member 211 is a coupling hole that has a rounded quadrangular shape formed to smoothly convert the rocking movement of the rocking member 211 into a linear motion of the engaging member 210. The coupling engagement portion 2101 of the engaging member 210 is a contact pin in contact with the inner edge portion of the coupling hole.

The engaging hole 2100 of the engaging member 210 is formed in a rectangular shape, and is openably disposed to have the longitudinal direction parallel to the longitudinal direction of the engaging member 210. As described above, the one end (the left end) of the engaging member 210 couples to the rocking member 211. On the other end (the right edge) of the engaging member 210, an engaging compression spring 2112 is arranged. The engaging compression spring 2112 presses the engaging member 210 from the other end side to the one end side (the left end side). The state where the engaging member 210 is positioned at the moving end on the one end side corresponds to the engaged position (see FIG. 13). The state where the engaging member 210 is positioned at the moving end on the other end side (the right end side) corresponds to the removal position (see FIG. 14).

On the back side of the pressing member 19, the pressing compression spring 190 that provides a pressure from the bottom surface of the bypass tray 15 is arranged. When the engaging member 210 moves to the removal position, the pressing member 19 is pushed up by the pressing compression spring 190 and then is moved up to the pressing position. On the back side of the pressing member 19, a regulation-distance adjusting portion 193 is arranged. The regulation-distance adjusting portion 193 employs a rack-pinion mechanism for adjusting the distance between regulating members that regulate the movement of the paper sheets placed on the bypass tray 15 in the direction perpendicular to the paper feeding direction.

The pressing member 19, the interlocking mechanism 20, and the restricting mechanism 21 in the paper feeding device 1 according to the present invention have the above-described configurations. Accordingly, the engaging member 210 moves from the engaged position to the removal position when the engaging member 210 is pressed from the one end side to the other end side by rocking of the rocking member 211 in association with rotation of the feed roller 16. When the engaging member 210 moves to the removal position, the engaging claw 191 of the pressing member 19 is disengaged from the engaging hole 2100 of the engaging member 210, and then the pressing member 19 moves up to the pressing position. When the rotation of the feed roller 16 is stopped, the engaging member 210 is moved from the other end side to the one end side, that is, from the removal position to the engaged position by the engaging compression spring 2112 arranged on the other end side of the engaging member 210. In the case where the engaging member 210 has moved to the engaged position, pushing down the pressing member 19 by a user causes an engagement state where the engaging claw 191 of the pressing member 19 engages the engaging hole 2100 of the engaging member 210.

When the drive roller is driven to rotate the rotation shaft 160 of the feed roller 16 so as to feed the paper sheet placed on the pressing member 19 of the paper feed tray to the image forming portion 18 along the conveyance guide 17, the interlocking rotating body 200 of the interlocking mechanism 20 rotates. The rotation of the interlocking mechanism 20 is transmitted to the contacting member 201 by the pressure contact member 202. The contacting member 201 presses using the contacting portion 2010 until the restricting mechanism 21 moves from the restricting position to the removal position. In the restricting mechanism 21 pressed by the contacting member 201 of the interlocking mechanism 20, the rocking member 211 rocks to slide the engaging member 210. Sliding of the engaging member 210, that is, moving of the engaging member 210 from the restricting position to the removal position disengages the engaging claw 191 of the pressing member 19 and moves up the pressing member 19 to the pressing position. Thus, the pressing member 19 presses the paper sheets against the feed roller 16.

The paper feeding device 1 thus configured according to the present invention and the image forming apparatus 2 using the paper feeding device 1 do not need a mechanism such as an electromagnetic clutch that is likely to cause a large-size device and a complicated control system. This provides beneficial effects for facilitating reduction in size and thickness of the device without causing an unnecessarily complicated control system and similar effect.

(Second Embodiment)

As a second embodiment, a description will be given of an example where the above-described first embodiment is applied to another paper feed mechanism. In the following description, like reference numerals designate corresponding or identical elements to those in the first embodiment, and therefore such elements with reference to the first embodiment will not be further elaborated here.

In the paper feeding device 1 whose schematic perspective view is illustrated in FIG. 1, the drawer of the drawable storing portion 14 is arranged on the front surface (the left side in the view) of the paper feeding device 1. The storing portion 14 is a paper sheet cassette in which paper sheets are stacked to be stored. The storing portion 14 is drawn to store the paper sheets.

In the second embodiment, to feed a paper sheet stored in the storing portion 14, various mechanisms such as a feed roller, a pressing member, a restricting mechanism, and an interlocking mechanism are arranged on the storing portion 14 side. These various mechanisms are constituted to have functions similar to those of the various mechanisms described in detail in the first embodiment, so as to realize moving up of the pressing member without using the electromagnetic clutch. This allows realizing the downsized paper feeding device 1 without causing an unnecessarily complicated control system.

Here, the various mechanisms such as the feed roller, the pressing member, the restricting mechanism, and the interlocking mechanism on the storing portion 14 side each require a slight change of design for sizes, shapes, arrangement, and similar parameter due to different arrangement positions from those in the first embodiment. However, the configuration is otherwise substantially similar to that of the first embodiment. Thus, the detailed view and description are omitted.

(Third Embodiment)

As a third embodiment, a description will be given of an example where the above-described first embodiment is applied to another paper feed mechanism. In the following description, like reference numerals designate corresponding or identical elements to those in the first embodiment, and therefore such elements with reference to the first embodiment will not be further elaborated here.

In the paper feeding device 1 whose schematic perspective view is illustrated in FIG. 1, the reading portion 10 in the upper portion of the paper feeding device 1 includes the placement table 100 on which the document to be the reading target is placed. The reading portion 10 takes in the document placed on the placement table 100 using the take-in roller (not illustrated), reads an image from the taken document, and then discharges the document. That is, the reading portion 10 has a mechanism for feeding a paper sheet. The third embodiment is based on this concept, and is an embodiment that constitutes the paper feeding device 1 according to the present invention. In the paper feeding device 1, a pressing member is disposed in the placement table 100. The take-in roller is constituted to function as a feed roller. Further, various mechanisms such as a restricting mechanism and an interlocking mechanism are disposed.

Here, the various mechanisms such as the feed roller (the take-in roller), the pressing member, the restricting mechanism, and the interlocking mechanism on the reading portion 10 side each require a slight change of design for sizes, shapes, arrangement, and similar parameter due to different arrangement positions from those in the first embodiment.

However, the configuration is otherwise substantially similar to that of the first embodiment. Thus, the detailed view and description are omitted.

The above-described first to third embodiments are only disclosure of some embodiments of the countless embodiments of the present invention, and can be appropriately designed taking into consideration various factors such as a purpose, usage, specifications, and setting.

For example, the paper feeding device 1 can be deployed in a device other than the image forming apparatus 2, for example, various devices such as a counting device that counts the number of paper sheets and a cutting device that cuts paper sheets.

Here, for convenience, the paper feeding device is used for reference. However, the term "paper sheet" here is used as a term in a broad sense. That is, the medium to be fed may be an object other than a paper sheet in a narrow sense, for example, an OHP film insofar as the medium to be fed is a paper-like object available as a paper sheet, that is, a sheet-shaped object.

Additionally, as the respective members, preferred members may be selected as necessary without departing from the scope of the present invention. For example, a plate spring may be used instead of the pressing compression spring 190 that pushes up the pressing member 19. Additionally, the interlocking mechanism 20 can be appropriately designed to be formed, for example, as a crank that converts a rotational motion into a pressure.

In the above-described embodiment, the description has been given of the example where the feed roller 16 is secured to the rotation shaft 160 and the feed roller 16 rotates by rotation of the rotation shaft 160 as a configuration. However, a possible configuration is that the rotation shaft is secured so as not to rotate and the feed roller is freely rotatable with respect to the rotation shaft. In this case, the driving force is transmitted to the feed roller via interposing objects such as a belt and a gear, and these interposing objects cause operation of another mechanism such as the interlocking mechanism. That is, for convenience, the term "rotation shaft" is used but does not necessarily mean rotation of the shaft itself. The same applies to the shafts of the other mechanisms, and the relationship between the shaft and various rotating bodies supported by the shaft can be designed taking into consideration various factors such as a purpose, usage, and specifications.

The present invention is also applicable to a paper feed mechanism other than the bypass tray, the paper sheet cassette, and the placement table. Furthermore, the first to third embodiments can be realized individually from one another. However, the present invention may be carried out in the configuration where a plurality of the embodiments are included in one paper feeding device 1.

As described above in detail, the paper feeding device 1 according to this application is a paper feeding device 1 for pressing paper sheets placed on a tray against a feed roller 16 by a pressing member 19 movable up and down to feed the paper sheet to a feeding destination by rotation of the feed roller 16. The paper feeding device 1 includes the pressing member 19, a restricting mechanism 21, and an interlocking mechanism 20. The pressing member 19 is movable up and down between a pressing position and a release position. The pressing position causes a pressure to paper sheets against the feed roller 16. The release position causes a release of the pressure. The restricting mechanism 21 is movable between a restricting position and a removal position. The restricting position causes a restriction on moving up of the pressing member 19 to the pressing position. The removal position causes a removal of the restriction. The interlocking mechanism 20 moves the restricting mechanism 21 to the removal position in interlock with rotation of the feed roller 16.

Accordingly, the paper feeding device 1 does not require a mechanism such as an electromagnetic clutch that is likely to cause a large-size device and a complicated control system.

In the paper feeding device 1 according to this application, the interlocking mechanism 20 includes an interlocking rotating body 200, a contacting member 201, and a pressure contact member 202. The interlocking rotating body 200 rotates in interlock with rotation of the feed roller 16. The contacting member 201 moves the restricting mechanism 21 in contact with the restricting mechanism 21. The pressure contact member 202 is configured to bring the interlocking rotating body 200 into pressure contact with the contacting member 201. The contacting member 201 presses the restricting mechanism 21 in association with rotation of the interlocking rotating body 200 in pressure contact until the restricting mechanism 21 moves to at least the removal position.

Accordingly, the paper feeding device 1 allows transmitting the rotational motion of the rotation shaft 160 of the feed roller 16 to the restricting mechanism 21 as a pressing action.

In the paper feeding device 1 according to this application, the contacting member 201 is configured to: provide a pressure until the restricting mechanism 21 moves to the removal position by an interlocking action in association with rotation of the interlocking rotating body 200 in pressure contact; stop the interlocking action after the restricting mechanism 21 has reached the removal position; and then be brought into slidable contact with the interlocking rotating body 200 in a rotating state.

Accordingly, the rotational motion of the rotation shaft 160 of the feed roller 16 included in the paper feeding device 1 is transmitted until the restricting mechanism 21 reaches the removal position. After the restricting mechanism 21 has reached the removal position, the interlocking action stops.

In the paper feeding device 1 according to this application, the interlocking rotating body 200 is a spur gear in a closed-bottomed cylindrical shape where teeth are formed on a side surface, and meshes with a roller-side gear 203 via an intermediate gear 204. The roller-side gear 203 rotates together with the feed roller 16 by rotation of a shaft (the rotation shaft 160) shared with the feed roller 16. The pressure contact member 202 is a compression spring (the pressing compression spring 190) internally fitted to the interlocking rotating body 200 so as to bring a bottom surface of the interlocking rotating body 200 into pressure contact with the contacting member 201. The contacting member 201 is loose-fitted to a shaft for pivotally supporting the intermediate gear 204, holds the shaft of the interlocking rotating body 200, and presses the restricting mechanism 21 in association with rotation of the interlocking rotating body 200 in pressure contact as a rocking cam that rocks around a shaft of the intermediate gear 204.

Accordingly, the rotational motion of the rotation shaft 160 of the feed roller 16 included in the paper feeding device 1 is transmitted until the restricting mechanism 21 reaches the removal position, and then the interlocking action is stopped after the restricting mechanism 21 reaches the removal position.

In the paper feeding device 1 according to this application, the restricting mechanism 21 has an engaging hole 2100 that engages the pressing member 19. The restricting mechanism 21 engages the pressing member 19 in the restricting position and removes the engagement in the removal position.

Accordingly, the restricting mechanism 21 included in the paper feeding device 1 restricts moving up of the pressing member 19 by engagement of the engaging hole 2100.

In the paper feeding device 1 according to this application, the restricting mechanism 21 includes an engaging member 210 and a rocking member 211. The engaging member 210 has the engaging hole 2100. The rocking member 211 is coupled to the engaging member 210. The rocking member 211 rocks by an action of the interlocking mechanism 20. The engaging member 210 moves from the restricting position to the removal position in interlock with rocking of the rocking member 211.

Accordingly, in the restricting mechanism 21 included in the paper feeding device 1, the rocking member 211 and the engaging member 210 engage the pressing member 19 and remove this engagement in cooperation with each other.

In the paper feeding device 1 according to this application, the restricting mechanism 21 is formed in a long plate shape. The restricting mechanism 21 includes an engaging member 210 and a rocking member 211. The engaging member 210 has an engaging hole 2100. The engaging hole 2100 engages the pressing member 19 in the restricting position. The rocking member 211 is coupled to the engaging member 210. The rocking member 211 rocks by an action of the interlocking mechanism 20. The rocking member 211 has a slide link portion 2111 configured to convert the rocking by the action of the interlocking mechanism 20 into a linear motion in a longitudinal direction of the engaging member. The engaging member 210 is movable in a longitudinal direction between the restricting position and the removal position. The restricting position causes the engaging member 210 to engage the pressing member 19 in the engaging hole 2100. The removal position causes a removal of the engagement. The engaging member 210 includes a coupling engagement portion 2101 that engages the slide link portion 2111. The coupling engagement portion 2101 moves from the restricting position to the removal position by an action of the slide link portion 2111.

Accordingly, in the restricting mechanism 21 included in the paper feeding device 1, the rocking member 211 and the engaging member 210 engage the pressing member 19 and remove this engagement in cooperation with each other.

In the paper feeding device 1 according to this application, the pressing member 19 is formed in a plate shape that has a placement surface on which paper sheets are placed. The pressing member 19 includes a rocking shaft 192, a compression spring (the pressing compression spring 190), and an engaging claw 191. The rocking shaft 192 is arranged parallel to a rotation shaft 160 of the feed roller 16. The compression spring is positioned on a back side of the placement surface. The engaging claw 191 engages the restricting mechanism 21.

Accordingly, the pressing member 19 included in the paper feeding device 1 presses the paper sheets by pushing up from the back side of the pressing compression spring 190. Additionally, engaging the pressing member 19 with the engaging claw 191 causes the state where the pressing is released.

Further, the image forming apparatus 2 according to this application includes the paper feeding device 1 and an image forming portion 18 configured to form an image on a paper sheet fed from the paper feeding device 1.

Accordingly, the image forming apparatus 2 does not require a mechanism such as an electromagnetic clutch that is likely to cause a large-size device and a complicated control system.

REFERENCE SIGNS LIST

1 paper feeding device
2 image forming apparatus
10 reading portion
100 placement table
11 operation panel
12 discharging portion
13 opening/closing portion
14 storing portion
15 bypass tray
150 cover plate
151 folded plate
16 feed roller
160 rotation shaft
161 drive gear
17 conveyance guide
18 image forming portion
19 pressing member
190 pressing compression spring
191 engaging claw
192 rocking shaft
193 regulation-distance adjusting portion
20 interlocking mechanism
200 interlocking rotating body
201 contacting member
2010 contacting portion
2011 biasing member
202 pressure contact member
203 roller-side gear
204 intermediate gear
21 restricting mechanism
210 engaging member
2100 engaging hole
2101 coupling engagement portion
211 rocking member
2110 protruding portion
2111 slide link portion
2112 engaging compression spring

What is claimed is:

1. An image forming apparatus, comprising:

a paper feeding device configured to press a paper sheet placed on a tray against a feed roller to feed the paper sheet to a feeding destination by rotation of the feed roller; and an image forming portion configured to form an image on a paper sheet fed from the paper feeding device, wherein the paper feeding device includes:

a pressing member movable up and down between a pressing position and a release position, the pressing position causing a pressure to a paper sheet against the feed roller, the release position causing a release of the pressure;

a restricting mechanism movable between a restricting position and a removal position, the restricting position causing a restriction on moving up of the pressing member to the pressing position, the removal position causing a removal of the restriction; and an interlocking mechanism configured to move the restricting mechanism to the removal position in interlock with rotation of the feed roller, the interlocking mechanism includes:

an interlocking rotating body configured to rotate in interlock with rotation of the feed roller;

a contacting member configured to move the restricting mechanism in contact with the restricting mechanism; and a pressure contact member configured to bring the interlocking rotating body into pressure contact with the contacting member, and the contacting member is configured to press the restricting mechanism and move the restricting mechanism to the removal position by an interlocking action in association with the rotation of the feed roller in pressure contact, to stop the interlocking action and be brought into slidable contact with the interlocking rotating body in a rotating state after the restricting mechanism has reached the removal position, and to press the restricting mechanism until the rotation of the feed roller stops.

2. The image forming apparatus according to claim 1, wherein the restricting mechanism has an engaging hole that engages the pressing member, engages the pressing member in the restricting position, and removes the engagement in the removal position.

3. The image forming apparatus according to claim 2, wherein the restricting mechanism includes:

an engaging member having the engaging hole; and a rocking member coupled to the engaging member, wherein the rocking member is configured to rock by an action of the interlocking mechanism, and the engaging member is configured to move from the restricting position to the removal position in interlock with rocking of the rocking member.

4. The image forming apparatus according to claim 2, wherein the restricting mechanism includes:

an engaging member in a long plate shape with the engaging hole configured to engage the pressing member in the restricting position; and a rocking member coupled to the engaging member, wherein the rocking member is configured to rock by an action of the interlocking mechanism, the rocking member including a slide link portion configured to convert the rocking by the action of the interlocking mechanism into a linear motion in a longitudinal direction of the engaging member, the engaging member is movable in a longitudinal direction between the restricting position and the removal position, the restricting position causing the engaging member to engage the pressing member in the engaging hole, the removal position causing a removal of the engagement, the engaging member includes a coupling engagement portion that engages the slide link portion, and the coupling engagement portion is configured to move from the restricting position to the removal position by an action of the slide link portion.

5. The image forming apparatus according to claim 2, wherein the pressing member has a plate shape with a placement surface on which a paper sheet is placed, and the pressing member includes:

a rocking shaft arranged parallel to a rotation shaft of the feed roller;

a compression spring positioned on a back side of the placement surface; and an engaging claw configured to engage the restricting mechanism.

6. An image forming apparatus, comprising:

a paper feeding device configured to press a paper sheet placed on a tray against a feed roller to feed the paper sheet to a feeding destination by rotation of the feed roller; and an image forming portion configured to form an image on a paper sheet fed from the paper feeding device, wherein the paper feeding device includes:

a pressing member movable up and down between a pressing position and a release position, the pressing position causing a pressure to a paper sheet against the feed roller, the release position causing a release of the pressure;

a restricting mechanism movable between a restricting position and a removal position, the restricting position causing a restriction on moving up of the pressing member to the pressing position, the removal position causing a removal of the restriction; and an interlocking mechanism configured to move the restricting mechanism to the removal position in interlock with rotation of the feed roller, wherein the interlocking mechanism includes:

an interlocking rotating body configured to rotate in interlock with rotation of the feed roller;

a contacting member configured to move the restricting mechanism in contact with the restricting mechanism; and a pressure contact member configured to bring the interlocking rotating body into pressure contact with the contacting member, wherein the contacting member presses the restricting mechanism in association with rotation of the interlocking rotating body in pressure contact until the restricting mechanism moves to at least the removal position, and wherein the interlocking rotating body is a spur gear in a closed-bottomed cylindrical shape where teeth are formed on a side surface, and meshes with a roller-side gear via an intermediate gear, the roller-side gear being configured to rotate together with the feed roller by rotation of a shaft shared with the feed roller, the pressure contact member is a compression spring internally fitted to the interlocking rotating body so as to bring a bottom surface of the interlocking rotating body into pressure contact with the contacting member, and the contacting member is loose-fitted to a shaft for pivotally supporting the intermediate gear, holds a shaft of the interlocking rotating body, and is configured to press the restricting mechanism in association with rotation of the interlocking rotating body in pressure contact as a rocking cam that rocks around a shaft of the intermediate gear as a rocking center.

7. The image forming apparatus according to claim 6, wherein the contacting member is configured to: provide a pressure until the restricting mechanism moves to the removal position by an interlocking action in association with rotation of the interlocking rotating body in pressure contact; stop the interlocking action after the restricting mechanism has reached the removal position; and then be brought into slidable contact with the interlocking rotating body in a rotating state.

8. The image forming apparatus according to claim 6, wherein the restricting mechanism has an engaging hole that engages the pressing member, engages the pressing member in the restricting position, and removes the engagement in the removal position.

9. The image forming apparatus according to claim 8, wherein the restricting mechanism includes:

an engaging member having the engaging hole; and a rocking member coupled to the engaging member, wherein the rocking member is configured to rock by an action of the interlocking mechanism, and the engaging member is configured to move from the restricting position to the removal position in interlock with rocking of the rocking member.

10. The image forming apparatus according to claim 8, wherein the restricting mechanism includes:

an engaging member in a long plate shape with the engaging hole configured to engage the pressing member in the restricting position; and a rocking member coupled to the engaging member, wherein the rocking member is configured to rock by an action of the interlocking mechanism, the rocking member including a slide link portion configured to convert the rocking by the action of the interlocking mechanism into a linear motion in a longitudinal direction of the engaging member, the engaging member is movable in a longitudinal direction between the restricting position and the removal position, the restricting position causing the engaging member to engage the pressing member in the engaging hole, the removal position causing a removal of the engagement, the engaging member includes a coupling engagement portion that engages the slide link portion, and the coupling engagement portion is configured to move from the restricting position to the removal position by an action of the slide link portion.

11. An image forming apparatus, comprising:

a paper feeding device configured to press a paper sheet placed on a tray against a feed roller to feed the paper sheet to a feeding destination by rotation of the feed roller; and an image forming portion configured to form an image on a paper sheet fed from the paper feeding device, wherein the paper feeding device includes:

a pressing member movable up and down between a pressing position and a release position, the pressing position causing a pressure to a paper sheet against the feed roller, the release position causing a release of the pressure;

a restricting mechanism movable between a restricting position and a removal position, the restricting position causing a restriction on moving up of the pressing member to the pressing position, the removal position causing a removal of the restriction; and an interlocking mechanism configured to move the restricting mechanism to the removal position in interlock with rotation of the feed roller, wherein the restricting mechanism has an engaging hole that engages the pressing member, engages the pressing member in the restricting position, and removes the engagement in the removal position.

12. The image forming apparatus according to claim 11, wherein the restricting mechanism includes:

an engaging member having the engaging hole; and a rocking member coupled to the engaging member, wherein the rocking member is configured to rock by an action of the interlocking mechanism, and the engaging member is configured to move from the restricting position to the removal position in interlock with rocking of the rocking member.

13. The image forming apparatus according to claim 11, wherein the restricting mechanism includes:

an engaging member in a long plate shape with the engaging hole configured to engage the pressing member in the restricting position; and a rocking member coupled to the engaging member, wherein the rocking member is configured to rock by an action of the interlocking mechanism, the rocking member including a slide link portion configured to convert the rocking by the action of the interlocking mechanism into a linear motion in a longitudinal direction of the engaging member, the engaging member is movable in a longitudinal direction between the restricting position and the removal position, the restricting position causing the engaging member to engage the pressing member in the engaging hole, the removal position causing a removal of the engagement, the engaging member includes a coupling engagement portion that engages the slide link portion, and the coupling engagement portion is configured to move from the restricting position to the removal position by an action of the slide link portion.

14. The image forming apparatus according to claim 11, wherein the pressing member has a plate shape with a placement surface on which a paper sheet is placed, and the pressing member includes:

a rocking shaft arranged parallel to a rotation shaft of the feed roller;

a compression spring positioned on a back side of the placement surface; and an engaging claw configured to engage the restricting mechanism.

15. An image forming apparatus, comprising:

a paper feeding device configured to press a paper sheet placed on a tray against a feed roller to feed the paper sheet to a feeding destination by rotation of the feed roller; and an image forming portion configured to form an image on a paper sheet fed from the paper feeding device, wherein the paper feeding device includes:

a pressing member movable up and down between a pressing position and a release position, the pressing position causing a pressure to a paper sheet against the feed roller, the release position causing a release of the pressure;

a restricting mechanism movable between a restricting position and a removal position, the restricting position causing a restriction on moving up of the pressing member to the pressing position, the removal position causing a removal of the restriction; and an interlocking mechanism configured to move the restricting mechanism to the removal position in interlock with rotation of the feed roller, wherein the pressing member has a plate shape with a placement surface on which a paper sheet is placed, and the pressing member includes:

a rocking shaft arranged parallel to a rotation shaft of the feed roller;

a compression spring positioned on a back side of the placement surface; and an engaging claw configured to engage the restricting mechanism.

16. The image forming apparatus according to claim 15, wherein the interlocking mechanism includes:

an interlocking rotating body configured to rotate in interlock with rotation of the feed roller;

a contacting member configured to move the restricting mechanism in contact with the restricting mechanism; and a pressure contact member configured to bring the interlocking rotating body into pressure contact with the contacting member, wherein the contacting member presses the restricting mechanism in association with rotation of the interlocking rotating body in pressure contact until the restricting mechanism moves to at least the removal position.

17. The image forming apparatus according to claim 16, wherein the contacting member is configured to: provide a pressure until the restricting mechanism moves to the removal position by an interlocking action in association with rotation of the interlocking rotating body in pressure contact; stop the interlocking action after the restricting mechanism has reached the removal position; and then be brought into slidable contact with the interlocking rotating body in a rotating state.

18. The image forming apparatus according to claim 16, wherein the interlocking rotating body is a spur gear in a closed-bottomed cylindrical shape where teeth are formed on a side surface, and meshes with a roller-side gear via an intermediate gear, the roller-side gear being configured to rotate together with the feed roller by rotation of a shaft shared with the feed roller, the pressure contact member is a compression spring internally fitted to the interlocking rotating body so as to bring a bottom surface of the interlocking rotating body into pressure contact with the contacting member, and the contacting member is loose-fitted to a shaft for pivotally supporting the intermediate gear, holds a shaft of the interlocking rotating body, and is configured to press the restricting mechanism in association with rotation of the interlocking rotating body in pressure contact as a rocking cam that rocks around a shaft of the intermediate gear as a rocking center.

19. The image forming apparatus according to claim 15, wherein the restricting mechanism has an engaging hole that engages the pressing member, engages the pressing member in the restricting position, and removes the engagement in the removal position.

20. The image forming apparatus according to claim 19, wherein the restricting mechanism includes:

an engaging member having the engaging hole; and a rocking member coupled to the engaging member, wherein the rocking member is configured to rock by an action of the interlocking mechanism, and the engaging member is configured to move from the restricting position to the removal position in interlock with rocking of the rocking member.

21. The image forming apparatus according to claim 19, wherein the restricting mechanism includes:

an engaging member in a long plate shape with the engaging hole configured to engage the pressing member in the restricting position; and a rocking member coupled to the engaging member, wherein the rocking member is configured to rock by an action of the interlocking mechanism, the rocking member including a slide link portion configured to convert the rocking by the action of the interlocking mechanism into a linear motion in a longitudinal direction of the engaging member, the engaging member is movable in a longitudinal direction between the restricting position and the removal position, the restricting position causing the engaging member to engage the pressing member in the engaging hole, the removal position causing a removal of the engagement, the engaging member includes a coupling engagement portion that engages the slide link portion, and the coupling engagement portion is configured to move from the restricting position to the removal position by an action of the slide link portion.

* * * * *